US006789806B2

(12) United States Patent
Santa Cruz et al.

(10) Patent No.: US 6,789,806 B2
(45) Date of Patent: Sep. 14, 2004

(54) ACESSESORY DEVICE FOR USE IN COMBINATION WITH A SNOWBOARD

(76) Inventors: Cathy D. Santa Cruz, 7630 Tholl Dr., Reno, NV (US) 89506; Daniel Farside, P.O. Box 50331, Sparks, NV (US) 89435

( * ) Notice: Subject to any disclaimer, the term of this patent is extended or adjusted under 35 U.S.C. 154(b) by 0 days.

(21) Appl. No.: 10/349,901

(22) Filed: Jan. 23, 2003

(65) Prior Publication Data

US 2004/0145152 A1 Jul. 29, 2004

(51) Int. Cl.[7] ..... A63C 5/03
(52) U.S. Cl. ..... 280/14.21; 280/607
(58) Field of Search ..... 280/602, 14.21, 280/14.22, 14.24, 87.042, 607, 636, 7.12

(56) References Cited

U.S. PATENT DOCUMENTS 4,138,128 A * 2/1979 Criss ..... 280/16
4,161,323 A * 7/1979 Wetteland ..... 280/7.1
4,163,565 A * 8/1979 Weber ..... 280/14.21
5,411,282 A * 5/1995 Shannon ..... 280/606
5,474,321 A * 12/1995 Pritz ..... 280/607
6,413,197 B2 * 7/2002 McKechnie et al. ..... 482/146
6,481,725 B2 * 11/2002 Chou ..... 280/7.14
2002/0008360 A1 * 1/2002 Ellington ..... 280/14.21
2002/0043774 A1 * 4/2002 Chou ..... 280/7.12
2002/0070515 A1 * 6/2002 Barbieri et al. ..... 280/14.21
2002/0158430 A1 * 10/2002 Farcot et al. ..... 280/14.21
2003/0085537 A1 * 5/2003 Breuer et al. ..... 280/14.21
2003/0160404 A1 * 8/2003 Bobrowicz ..... 280/14.21
2003/0193168 A1 * 10/2003 Chou ..... 280/607

FOREIGN PATENT DOCUMENTS

DE WO 88/00488 * 1/1988 ..... A63C/5/03
DE 3702093 A1 * 8/1988 ..... A63C/5/00

* cited by examiner

*Primary Examiner*—Christopher P. Ellis
*Assistant Examiner*—J. Allen Shriver

(57) ABSTRACT

Herein taught is a new device for improving the overall function and/or aerodynamic qualities of a typical snowboard. The device may be manufactured independently as an accessory item, or it may be included in the snowboard at the point of manufacture. The main improvement being an elongated member which when combined with a snowboard, functions as a springboard respectively. Whereby, bodily movements and/or energies of a user are transferred from the springboard into the snowboard and greatly aid with overall performance, especially jumping and turning.

3 Claims, 3 Drawing Sheets

ACESSESORY DEVICE FOR USE IN COMBINATION WITH A SNOWBOARD

FIELD OF THE INVENTION

This invention relates in general to snowboard accessories but more particularly pertains to an elongated springboard-like device that is attachable to a snowboard, respectively. Whereby, when used in combination with a snowboard improves control while turning, and also increases height when jumping. The device is substantially universal, lightweight, aesthetically pleasing, aerodynamic, and improves overall performance of the snowboard.

BACKGROUND OF THE INVENTION

Winter sport activities are quickly becoming very popular and as a result many different types of winter sport devices are now available. For example, there are numerous variations of snow skis, snow sleds, snow discs, etc. However, the most popular snow device currently available is known as a snowboard.

Snowboarding is a sport that evolved from skiing, respectively. Therefore, it is not surprising that the technology involved in snowboarding was also derived from skiing. Snowboards were initially manufactured by ski manufactures, and most of initial designers of snowboards were ski designers who understandably incorporated ski technology therein. As a result, there are many similarities today between skis and snowboards, which is reasonable, since both skis and snowboards are designed for travel over snow. For example, both skis and snowboards are made from the same materials combined in essentially the same way. Such as they both initially stated with all wood construction then later introduced synthetic materials, e.g., fiberglass ultra high molecular weight Polyethylenes, either singly or in laminated combinations with wood cores, steel edges, and plastic tops and sidewalls. Also, the techniques of manufacture were transferred virtually unchanged from skis to snowboards. Therefore, the similarities between skis and snowboards are obvious but the differences have not been thoroughly recognized or addressed.

Winter sport games and devices when first introduced were designed to simply glide over the snow, and their intended use was strictly for fun. However over the years, sport activities such as skiing and snowboarding have become more than just recreational fun. In fact snowboarding has become so popular that the youth of today have their own snowboard lingo and unique terminology for expressing particular moves and/or tricks that they rigorously perform. As a result of popularity, snowboarding is now considered by many athletes to be a serious profession that may be most profitable. Thus these athletes are very concerned and are desirous for new technology and improved overall performance of their skis and/or snowboards.

Unfortunately there have not recently been impressive advancements in snowboard technology, other than the addressing the materials from which they are made. Whereby, it is believed that the overall performance has not yet been achieved. Therefore there is a great need for snowboard improvements and this is what the present invention recognizes, addresses, and resolves in a manner heretofore not taught within the known prior art. However, it is to be understood that the present invention is not to be limited to use with snowboards alone, as the present device could easily be adapted for use with conventional skis, or it may be incorporated and used with future types of snow devices.

SUMMARY OF THE INVENTION

It is therefore a primary object of the present invention to provide an accessory device which when combined with a snowboard greatly improves the overall performance, especially turning, and/or jumping.

It is another object of the present invention to provide an accessory device for a snowboard that may be easily removably attached onto a pre-existing snowboard or ski, or in a different embodiment it may be incorporated into the construction of the snowboard or ski at the point of manufacture.

Still another object of the present invention is to provide an accessory device for a snowboard that may be produced and sold as a kit that is used for modifying a conventional snowboard.

Yet another object of the present invention is to provide an accessory device for a snowboard that may be produced in various sizes and/or shapes so as to be usable by athletes of different sizes or weights. For example, the device may be made for a child, an adolescent, or an adult, etc. Or still further the device may be adjustable so as to provide enhanced performance for individual users according to their specific needs and wants. Thus the accessory device may be customized either by the user themselves or by store personnel who are knowledgeable and trained to help first time users.

Another object of the present invention is to provide an accessory device for a snowboard that may be produced in numerous colors and/or shapes so as to be stylish and aesthetically pleasing to the eye. This is especially important with today's youth as they consider appearance to be a most important factor.

It is another object of the present invention to provide an accessory device for a snowboard that may be produced in numerous different embodiments. Whereby, each embodiment provides unusual end results and different novel effects.

Still another object of the present invention is to provide an accessory device for a snowboard that may be produced from substantially any suitable material of engineering choice that provides proper resiliency or spring-like action. For example, the device may be manufactured from spring steel, rubber, plastic, or the like.

Yet another object of the present invention is to provide an accessory device for a snowboard that reduces chatter and vibrations and adverse effects, such as muscle trauma. Thus the device when used with a snowboard is substantially safer and less likely to cause injuries associated with vibrations or chatter, etc. This further provides a snowboard that is more fun as the user is much more comfortable, thus reducing stress and increasing endurance or stamina of the user.

Other objects and advantages will be seen when taken into consideration with the following drawings and specification.

DETAILED DESCRIPTION OF THE DRAWINGS

Figure 1:
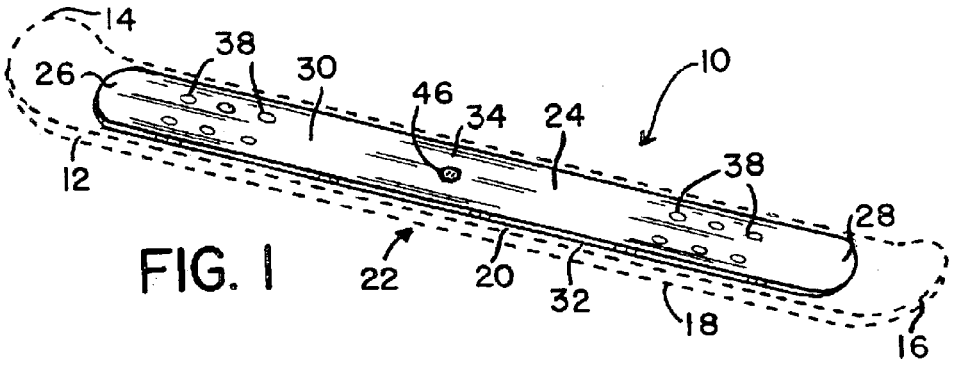
FIG. 1 is substantially a perspective overview of a first embodiment for the present invention.

Referring now in detail to the drawings wherein like characters refer to like elements throughout the various views. In FIG. 1, (10) substantially represents a first embodiment for the present invention which is an accessory device for use in combination with a pre-existing snowboard (12). It is to be understood that any typical snowboard of user choice may be used that provides a nose portion (14), a tail portion (16), a base surface (18), a top surface (20), and a central section (22) which is substantially located between each portion (14 & 16), respectively. However, it is to be noted the present invention may also be incorporated for use with other types of snow gliding devices, such as skis or the like. Thus the concept of use with other types of devices is to be inherent within the present invention.

Figure 2:
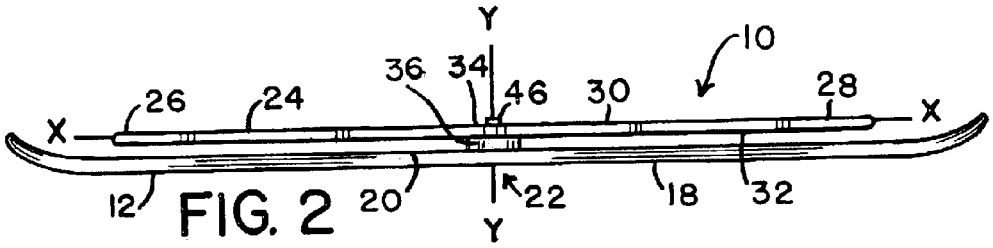
FIG. 2 is substantially a side view of the embodiment of FIG. 1.

As depicted in FIGS. 1 & 2, the first embodiment for accessory device (10) substantially comprises, the accessory device (10) being an elongated member (24) having a first end (26), a second end (28), a top surface (30), a bottom surface (32), a central region (34), and an attachment member (36). As further illustrated in FIG. 2, first end (26) and second end (28) define an X-axis respectively, and central region (34) is clearly located between each end (26 & 28) along a Y-axis relative to the noted X-axis. It is to be noted that elongated member (24) can be made from any suitable material of engineering choice. For example, it may be formed from spring steel rubber, aluminum, etc., or from any other material that provides the unusual results of increased spring-like resilient action.

As can be seen, when elongated member (24) is attached onto snowboard (12), the elongated member (24) substantially functions as a spring board which in turn transfers energy exerted by the user into the member (24), then from the member directly into the snowboard (12). Thus, increasing the overall performance of the snowboard (12), and this spring-like action proves to be especially useful when the user wishes to increase air-time and/or height when jumping.

As further depicted in FIG. 1, it can clearly be seen that elongated member (24) is to be used in the normal manner with typical foot bindings (not shown). Thus, elongated member (24) includes multiple foot binding mounting holes (38) located near each end (26 & 28), respectively. Therefore, elongated member (24) is functional with any suitable type of foot bindings of user choice, and is further adjustable for use by different riders having variable foot spans, accordingly.

As previously noted, elongated member (24) includes an attachment member (36) having attachment means for attaching and interconnecting elongated member (24) and snowboard (12) together, respectively. Again, it is to be noted that any suitable type of attachment means may be incorporated into the invention according to engineering choice. Thus, the following attachment members and attachment means as described herein are only exemplary of some suitable types of attachment means but the invention is not to be limited thereto.

Figure 3:
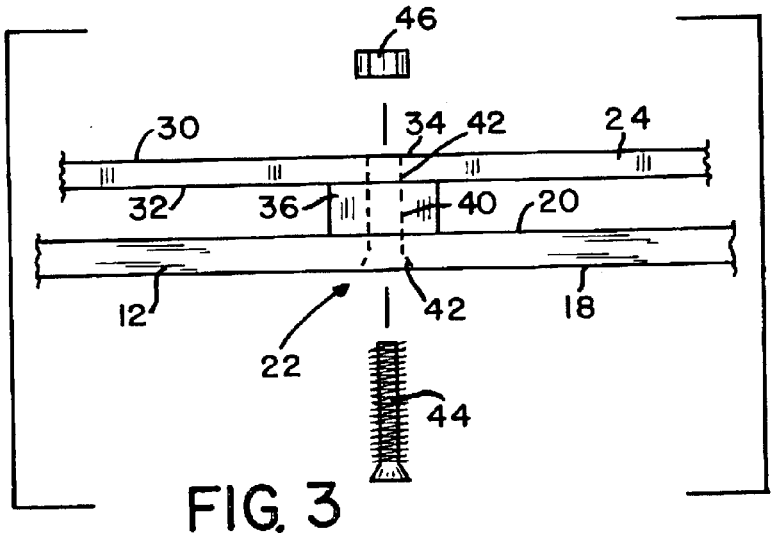
FIG. 3 is substantially an enlarged overview of the attachment means depicted in FIGS. 1 and 2.

As depicted in FIGS. 1–3 the noted attachment member (36) is substantially in the form of a block having at least one mounting hole (40) therein. If so desired multiple mounting holes may be incorporated, but only one is shown for clarity purposes and simplicity. Again it is to be known that the block can be made from any suitable material of engineering choice, such as wood, plastic, rubber, aluminum steel, etc. Further attachment means includes central region (34) and central section (22) each having at least one mounting hole (42) therein, and each of the mounting holes (40 and 42) are in alignment with each other. The noted attachment means further including at least one mounting bolt (44) which is of a shape and size to be threadably inserted into each mounting hole when aligned and secured in place by a fastener, such as nut (46). However, it may be advantageous to provide bolt (44) with an angled bolt head so as to allow the bolt and head to be recessed and have a flush relationship with base surface (18) when mounted. This reduces interference and allows base surface to glide smoothly over the snow.

Whereby it can now be seen that when the elongated member (24), attachment member (36) and snowboard (12) are aligned and affixed together by the noted attachment means, central region (34) and central section (22) have a spaced apart relationship, respectively. Thus, this allowing elongated member (24) enough clearance to substantially bounce without interfering with the snowboard (12) itself. It is to be understood this clearance is variable depending on the size of the attachment member (36) and is therefore not limited to any particular height, shape or size that is depicted herein.

Figure 4:
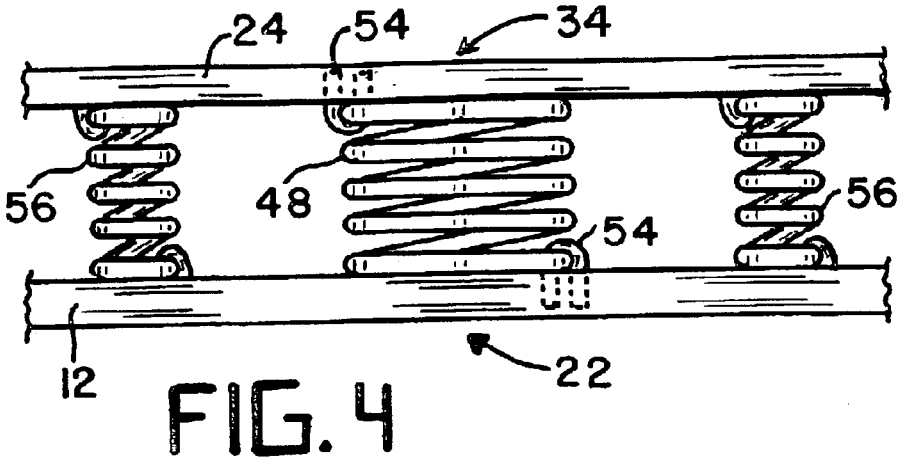
FIG. 4 is substantially an enlarged overview of a different type of attachment member and attachment means for the embodiment of FIGS. 1 and 2.

Referring now to FIG. 4 which depicts yet another suitable attachment means. Wherein the attachment member is in the form of a spring (48) having a first mounting leg (50) and a second mounting leg (52). First mounting leg (50) being attached by suitable attachment means onto central region (34) and second mounting leg (52) being attached by suitable attachment m onto central section (22). Again any suitable type of attachment means may be incorporated according to engineering choice, such as soldering, welding, bonding, adhesive, or the like. However, as depicted herein the attachment means includes at least one U-shaped clip (54) which is most suitable and functional. Whereby, it can clearly be seen this attachment means also allows central region and central section to have a spaced apart relationship, respectively. Furthermore, it can now be seen this type of attachment member provides additional spring-like action and this as a result helps to eliminate muscle strain for the user, which is most advantageous. It is to be noted that different types of springs and different arrangements may be incorporated. For example, the spring (48) may be aligned in different positions, such as it may be horizontally or diagonally positioned or the like.

Further depicted in FIG. 4, elongated member (24) if so desired may also include multiple spaced apart spring-like members (56) that are fixedly attached onto bottom surface (32). It is to be understood any type, shape or size of members (56) may be used and attached by any type of attachment means according to engineering choice. This again aids in the overall performance by increasing the spring-like action and this also allows the elongated member (24) and snowboard (12) to have a spaced apart relationship.

Figure 5:
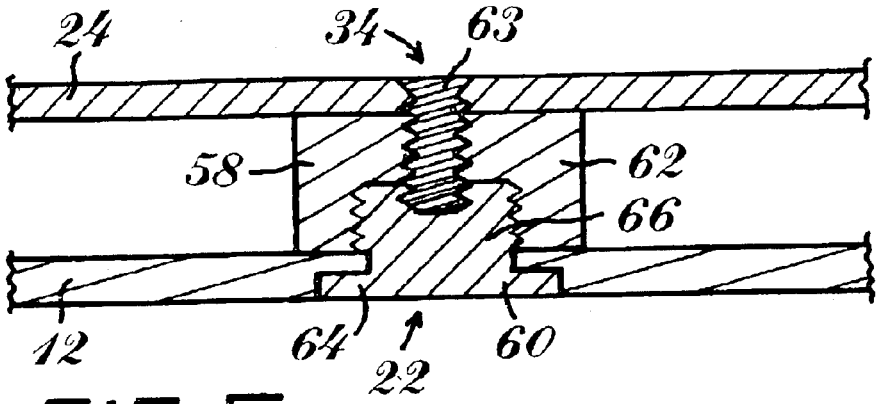
FIG. 5 is substantially an enlarged overview of a different type of attachment member and attachment means for the embodiment of FIGS. 1 and 2.

Referring now to FIG. 5 wherein we provide yet another type of attachment member and attachment means comprising of the following: Attachment member (58) is formed from an integrally formed plug insert (60) and a cap member (62) in combination. Integrally formed plug insert (60) includes an enlarged bottom section (64) which forms a protruding horizontal lip, and a top section (66) which forms an upraised vertical protrusion. It is to be seen that bottom section (64) and top section (66) may or may not be threaded. Furthermore, central section (22) includes a hole there through which is of a shaped and size to receive and mate with integrally formed plug insert (60) and cap member (62) is of a shape and size to be attached onto and mate with top section (66). Thus central region (34), cap member (62) and integrally formed plug insert (60) in combination when aligned with each other may be attached together by at least one centralized vertical hole which is of a shape and size to receive a suitable fastener therein, such as bolt (63) or the like. Whereby, when attached as described elongated member (24) and snowboard (12) have a spaced apart relationship.

Figure 6:
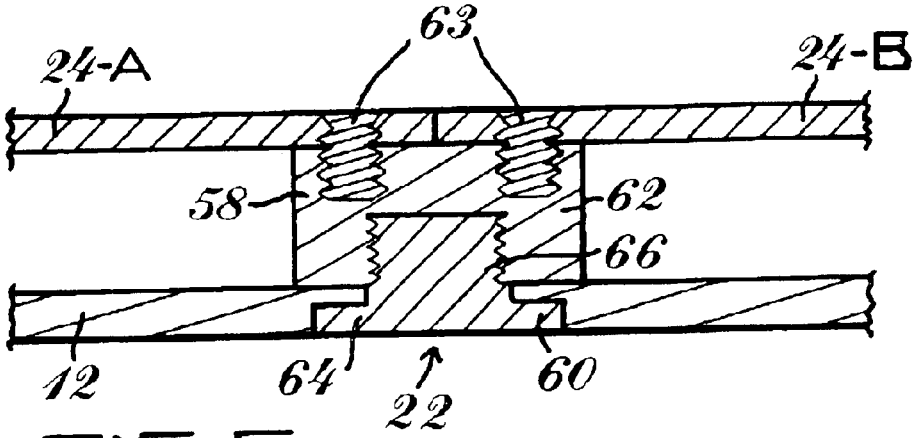
FIG. 6 is substantially an enlarged overview of a different type of attachment member and attachment means for the embodiment of FIGS. 1 and 2.
Figure 7:
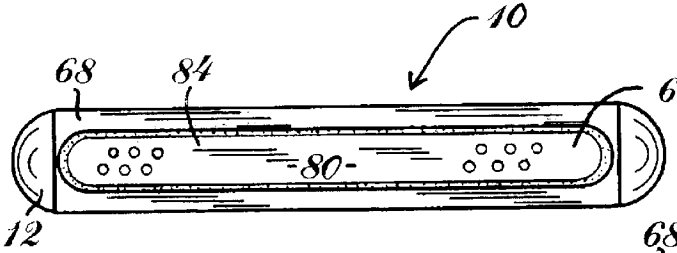
FIG. 7 is substantially a side view of a different embodiment for the present invention.

Referring now to FIG. 6 wherein we provide yet another variation for the attachment member and attachment means. Wherein, elongated member is now cut in two resulting in a first half section (24-A) and a second half section (24-B). This arrangement allows a user to interchange the first and second half sections according to their liking which is most advantageous. For example, the user may wish to attach half sections having different characteristics such as varying in size, shape, weight, etc. Such as the first half section (24-A) may be aerodynamically shaped for ultimate flight performance while the second half section (24-B) may be shaped to function as a tail fin, respectively. This results in varying the performance of the snowboard (12). It is to be understood much research and development is needed to determine the desired end result for actual construction of the elongated member (24) and/or half sections (24-A & 24-B). For example, experiments within a wind tunnel will need to be conducted, as well as other aerodynamic qualities will need to be determined before the ultimate design is achieved depending on the knowledge acquired.

The embodiment of FIG. 6 for the attachment means is substantially the same as that as taught in FIG. 5. However, in this arrangement the difference is first half section (24-A), cap member (62) and integrally formed plug insert (60) in combination when aligned with each other include at least one vertical hole for receiving a fastener (63) therein, and second half section (24-B), cap member (62) and integrally formed plug insert (60) in combination when aligned with each other include at least one vertical hole for receiving a fastener (63) therein. Whereby, different types of half sections can be interconnected and interchanged according to user preference.

Figure 8:
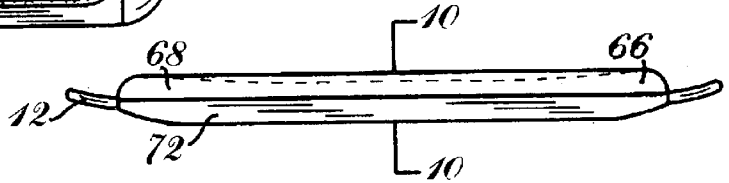
FIG. 8 is substantially a top view of the embodiment of FIG. 7.
Figure 9:
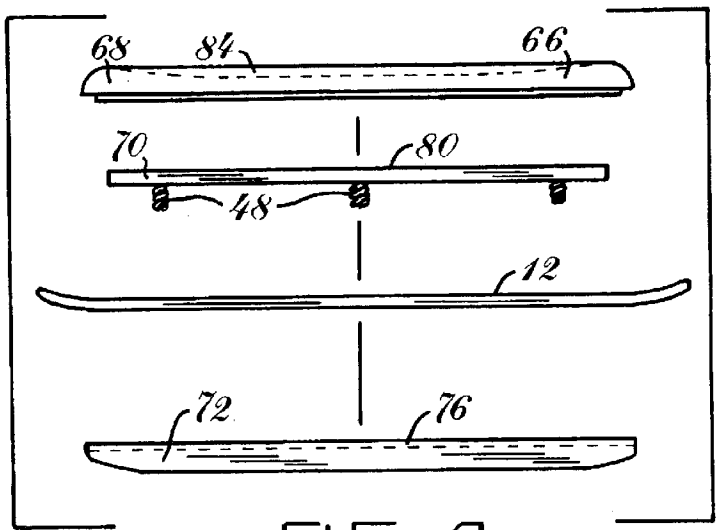
FIG. 9 is substantially an exploded plan view of the embodiment of FIGS. 7 and 8.
Figure 10:
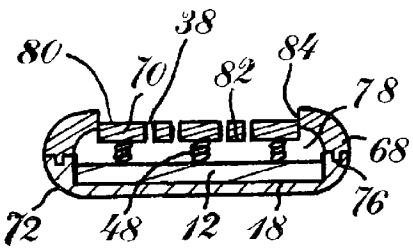
FIG. 10 is substantially a cut-away taken at 10—10 of FIG. 7.

Referring now to FIGS. 7–10 wherein we depict yet another embodiment for the present invention. As illustrated therein, elongated member (66) comprises a top half section (68), an intermediate section (70) and a bottom half section (72). Whereby, the noted attachment member and attachment means includes top half section (68) having downward facing side walls each having a downward facing lip (74) and bottom half section (72) having upward facing side walls each having a recessed groove (76), each of which are more clearly shown in FIGS. 9 & 10. Thus, it can be seen each downward facing lip (74) is of a shape and size to be frictionally engaged within a corresponding recessed groove (76) resulting in a friction fit and interconnecting or removably attaching each of the sections (68 & 72) together. As illustrated in FIG. 10, top half section (68) and bottom half section (72) substantially form an internal cavity (78) for containment of both snowboard (12) and intermediate section (70) therein. It is to be noted bottom half section (72) is of a shape and size to substantially mate with the base surface (18), this is important as a close fit it imperative so as to reduce any friction from any protruding part or section, thus provide a smooth ride and not interfere when gliding over the snow. Intermediate section (70) has an external top surface (80) and an internal bottom surface (82). Internal bottom surface (82) further includes multiple spaced apart spring-like members (48) fixedly attached thereon by suitable attachment means, such as previously disclosed. Top half section (68) having a cut out area (84) for exposing external top surface (80) and external top surface (80) further includes multiple foot binding mounting holes (38) which are used for mounting typical foot bindings (not shown) thereon. Furthermore as depicted in FIG. 8, cut out area (84) defines an edge (86). Edge (86) and external top surface (80) are interconnected by a flexible sealing ring (88) which reduces the chance of snow and other debris from entering into cavity (78). It is to be understood that any suitable type of sealing ring may be used which remains intact yet is flexible so as to allow intermediate member mobility without leaking or breaking. Such as a rubberized compound, an elasticized material, or the like.

It is to be noted this last embodiment is extremely functional as it allows the user to attach the present accessory (10) onto a snowboard (12) without the need for altering or marring the snowboard in any manner. This embodiment is further advantageous because it is very aesthetically appealing, aerodynamic, light weight and cost effective to produce, such as by plastic mold injection. Another advantage of this embodiment is that due to the use of springs, intermediate member (80) is slightly movable in all directions. Thus, this movement enhances overall function of the snowboard including jumping, turning, spinning, etc.

It can now be seen when the present invention and snowboard are combined and assembled as taught herein, a user can easily position themselves in the usual manner within the foot bindings (not shown) on top of the exposed external top surface (80) of the last embodiment, or onto the elongated member (24) of the prior disclosed embodiments. Thereafter, when the user initiates normal bodily movements typically associated with riding a snowboard all of their movements and energies are transferred to the snowboard and intensified resulting in increased performance. These novel and unusual results are achieved due to the spring-like action as taught within each of the embodiments of the present invention.

It is to be further understood other features may be included which further provide improved performance, such as elongated member (24) may include air scoops (not shown) which are designed to eliminate or reduce air drag. Or if preferred, elongated member (24) may also include wing type structures (not shown) that can be either integrally formed therewith or they may be removably attached, depending on engineering choice. Or still further, elongated member (24) may include a tail fin (not shown), or the like and this may also be integral or detachable.

It will now be seen we have herein provided a new and unique accessory device which is usable with a snowboard in combination and provides overall increased performance. However, it is to be understood if preferred, the present invention may easily be incorporated into the actual construction of the snowboard at the point of manufacture. Thus a snowboard having the features of the present invention incorporated therein and is sold as a snowboard, is in fact inherent and is an obvious design choice.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

Having described our invention, what we claim as new and desire to secure by Letters Patent is:

1. An accessory device for use in combination with a snowboard comprising: said accessory device being an elongated member having a first end; a second end; a top surface; a bottom surface; a central region; and an attachment member; said first end and said second end defining an X-axis, said central region being located between each said end along a Y-axis relative to said X-axis, said snowboard comprising a nose portion; a tail portion; a base surface; a top surface; and a central section between each said portion; and said attachment member having attachment means for attaching and interconnecting said elongated member and said snowboard together; whereby when said elongated member is attached onto said snowboard, said elongated member functions as a spring board and increases overall performance of said snowboard; wherein said attachment member is formed from an integrally formed plug insert and a cap member in combination, said integrally formed plug insert having an enlarged bottom section which forms a protruding horizontal lip, said plug insert having a top section which forms an upraised vertical protrusion, said central section of said snowboard having a hole there through which is of a shape and size to receive and mate with said integrally formed plug insert, said cap member being of a shape and size to be attached onto and mate with said top section of said integrally formed plug insert; and said central region, said cap member, and said integrally formed plug insert are aligned in combination with each other to form at least one centralized vertical hole for receiving a fastener therein; wherein said elongated member and said snowboard having a spaced apart relationship.

2. The accessory device for use in combination with a snowboard of claim 1 wherein said elongated member further includes multiple foot binding mounting holes near each said end.

3. An accessory device for use in combination with a snowboard comprising: said accessory device being an elongated member having a first end; a second end; a top surface; a bottom surface; a central region; and an attachment member; said first end and said second end defining an X-axis, said central region being located between each said end along a Y-axis relative to said X-axis, said snowboard comprising a nose portion; a tail portion; a base surface; a top surface; and a central section between each said portion; and said attachment member having attachment means for attaching and interconnecting said elongated member and said snowboard together; whereby when said elongated member is attached onto said snowboard, said elongated member functions as a spring board and increases overall performance of said snowboard; wherein said central region of said elongated member is cut into a first half section and a second half section, said attachment member is formed from an integrally formed plug insert and a cap member in combination, said integrally formed plug insert having an enlarged bottom section which forms a protruding horizontal lip, said plug insert having a top section which forms an upraised vertical protrusion, said central section of said snowboard having a hole there through which is of a shape and size to receive and mate with said integrally formed plug insert, said cap member being of a shaped and size to be attached onto and mate with said top section of said integrally formed plug insert; said first half section, said cap member, and said integrally formed plug insert are aligned in combination with each other to form at least one vertical hole for receiving a fastener therein; and said second half section, said cap member, and said integrally formed plug insert are aligned in combination with each other to form at least one vertical hole for receiving a fastener therein; whereby said elongated member and said snowboard have a spaced apart relationship.

* * * * *